US005556313A

United States Patent [19]

Ogino

[11] Patent Number: 5,556,313

[45] Date of Patent: Sep. 17, 1996

[54] OUTBOARD DRIVE TRANSMISSION

[75] Inventor: Hiroshi Ogino, Hamamatsu, Japan

[73] Assignee: Sanshin Kogyo Kabushiki Kaisha, Shizuoka-ken, Japan

[21] Appl. No.: 455,064

[22] Filed: May 31, 1995

Related U.S. Application Data

[63] Continuation-in-part of Ser. No. 346,383, Nov. 29, 1994, Pat. No. 5,514,014.

[30] Foreign Application Priority Data

Nov. 29, 1993 [JP] Japan ..... 5-298250
May 31, 1994 [JP] Japan ..... 6-119148

[51] Int. Cl.[6] ..... B63H 21/28

[52] U.S. Cl. ..... 440/75; 440/80; 416/129; 192/48.7

[58] Field of Search ..... 440/75, 79, 80, 440/81, 83; 416/128, 129 R, 129 A; 192/48.7, 114 R

[56] References Cited

U.S. PATENT DOCUMENTS

| | | | |
|---|---|---|---|
| 537,612 | 4/1895 | Leathers . | |
| 599,125 | 2/1898 | Fefel . | |
| 624,674 | 5/1899 | Painton . | |
| 938,911 | 11/1909 | Taylor . | |
| 1,807,254 | 5/1931 | Piano . | |
| 1,813,552 | 7/1931 | Stechauner . | |
| 1,853,694 | 4/1932 | Melcher . | |
| 2,058,361 | 10/1936 | Sherwood . | |
| 2,064,195 | 12/1936 | De Michelis . | |
| 2,347,906 | 5/1944 | Hatcher . | |
| 2,372,247 | 3/1945 | Billing . | |
| 2,672,115 | 3/1954 | Conover . | |
| 2,987,031 | 6/1961 | Odden . | |
| 2,989,022 | 6/1961 | Lundquist . | |
| 3,478,620 | 11/1969 | Shimanckas . | |
| 3,769,930 | 11/1973 | Pinkerton . | |
| 4,529,387 | 7/1985 | Brandt | 440/66 |
| 4,540,369 | 9/1985 | Caires | 440/81 |
| 4,619,584 | 10/1986 | Brandt | 416/129 |
| 4,642,059 | 2/1987 | Nohara | 440/75 |
| 4,741,670 | 5/1988 | Brandt | 416/129 |
| 4,767,269 | 8/1988 | Brandt | 416/129 |
| 4,790,782 | 12/1988 | McCormick | 440/75 |
| 4,792,314 | 12/1988 | McCormick | 440/81 |
| 4,793,773 | 12/1988 | Kinouchi et al. | 416/129 A |
| 4,795,382 | 1/1989 | McCormick | 440/81 |
| 4,828,518 | 5/1989 | Kouda et al. | 440/75 |
| 4,832,570 | 5/1989 | Solia | 440/67 |
| 4,832,636 | 5/1989 | McCormick | 440/80 |
| 4,840,136 | 6/1989 | Brandt | 440/78 |
| 4,887,982 | 12/1989 | Newman et al. | 440/81 |
| 4,887,983 | 12/1989 | Bankstahl et al. | 440/75 |
| 4,897,058 | 1/1990 | McCormick | 440/80 |
| 4,932,907 | 6/1990 | Newman et al. | 440/75 |
| 4,963,108 | 10/1990 | Koda et al. | 440/75 |
| 4,993,848 | 2/1991 | John et al. | 440/81 |
| 5,009,621 | 4/1991 | Bankstahl et al. | 440/75 |
| 5,017,168 | 5/1991 | Ackley | 440/82 |
| 5,030,149 | 7/1991 | Fujita | 440/75 |
| 5,186,609 | 2/1993 | Inoue et al. | 416/129 |
| 5,230,644 | 7/1993 | Meisenburg et al. | 440/80 |
| 5,232,386 | 8/1993 | Gifford | 440/80 |
| 5,249,995 | 10/1993 | Meisenburg et al. | 440/81 |
| 5,342,228 | 8/1994 | Magee et al. | 440/76 |
| 5,344,349 | 9/1994 | Meisenburg et al. | 440/80 |
| 5,352,141 | 10/1994 | Shields et al. | 440/80 |
| 5,366,398 | 11/1994 | Meisenburg et al. | 440/81 |

*Primary Examiner*—Jesus D. Sotelo
*Attorney, Agent, or Firm*—Knobbe, Martens, Olson & Bear

[57] ABSTRACT

A transmission for a counter-rotating propeller system of a watercraft outboard drive includes a reduced friction coupling between the inner and outer shafts which permits transfer of the thrust loading on the inner shaft to the outer shaft under a reverse drive condition. The inner and outer shafts include opposing transverse surfaces which are separated by a pair of anti-friction washers. The washers allow the shafts to rotate in opposite directions with minimum friction, while allowing the opposing surfaces to act on each other through the washers to transfer the trust loading when the watercraft is driven in reverse.

29 Claims, 5 Drawing Sheets

OUTBOARD DRIVE TRANSMISSION

RELATED CASES

The present application is a continuation-in-part of U.S. application Ser. No. 08/346,383, filed on Nov. 29, 1994 now U.S. Pat. No. 5,514,014. In addition, the present application and the parent application each claim foreign priority from Japanese Patent Application Serial Nos. Hei 6-119148 and Hei 5-298250, respectively.

BACKGROUND OF THE INVENTION

1. Field of the Invention

The present invention relates in general to a marine propulsion system, and more particularly to a transmission for a propulsion system of an outboard drive.

2. Description of Related Art

Many outboard drives of marine watercrafts employ counter-rotational propeller systems which utilize a pair of counter-rotating propellers that operate in series about a common rotational axis. By using propeller blades having a pitches of opposite hands, the dual propeller arrangement provides significant improvement in propulsion efficiency. Such propulsion systems are common in both outboard motors and in stern drive units of inboard/outboard motors.

A forward-neutral-reverse-type transmission commonly operates the counter-rotating propeller system. Prior transmission typically include a drive pinion and a pair of oppositely rotating driven bevel gears. A front dog clutch of the transmission is interposed between the pair of oppositely rotating gears. The front dog clutch is moved between positions in which the clutch engages the gears. In this manner, the front dog clutch selectively couples an inner propeller shaft to one of the driven gears to rotate a first propeller in either a forward or a reverse direction to establish either a forward or a reverse drive condition, respectively.

The transmission also includes a rear dog clutch that is positioned on the rear side of the rear driven gear hub. The rear clutch selectively engages corresponding teeth formed on the rear side of the hub of the rear gear. The rear clutch is connected to an outer propulsion shaft which it drives when engaged with the rear gear.

The outer shaft commonly includes a thrust flange. The thrust flange acts against a bearing carrier and/or thrust bearings to transfer thrust loadings on the shaft to the lower unit.

The inner shaft commonly acts against the driven bevel gears to transfer thrust loadings on the inner shaft under the forward and reverse drive conditions. For instance, the inner shaft acts against the rear bevel gear when under a reverse drive condition to transfer a reverse thrust loading. A thrust bearing assembly, which normally takes the comparatively minimum loading of the bevel gear itself, takes this additional loading under a reverse drive condition. The thrust bearing thus is either over sized for the majority of the loadings applied to it, or is over loaded under a reverse drive condition. Such over loading of the thrust bearing causes the bearing to wear quickly and requires frequent replacement.

SUMMARY OF THE INVENTION

A need therefore exists for a transmission arrangement in which thrust loadings on the inner shaft under at least one drive condition are transferred to the lower unit without loading the driven gears of the transmission and in a manner minimizing frictional contact between the inner shaft and the other components of the transmission.

In accordance with one aspect of the present invention, a transmission for a watercraft outboard drive comprises first and second counter-rotating gears. A first clutch is connected to a first propulsion shaft and is adapted to selectively engage one of the first or second gears to establish a first and a second drive condition. A second clutch is coupled to the first clutch and is connected to a second propulsion shaft. The second clutch is adapted to selectively engage the second gear to drive the second shaft under one of the drive conditions. The first shaft includes a step which receives a first washer and the second shaft includes an abutment surface which a second washer acts against. The first and second washers are arranged to act against each other in a manner allowing the transfer of thrust loading on the first shaft to the second shaft through the step and the abutment surface under one of the drive conditions.

Another aspect of the present invention involves a propulsion shaft assembly coupled to a marine outboard drive transmission. The propulsion shaft assembly comprises first and second coaxial shafts. The first shaft includes a generally annular transverse surface which opposes a generally annular transverse surface of the second shaft. At least first and second washers separate the transverse surfaces. The first washer is coupled to the first shaft and the second washer is coupled to the second shaft. The washers are arranged to act against each other in a manner allowing the transfer of thrust loading on the first shaft to the second shaft in at least one axial direction.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
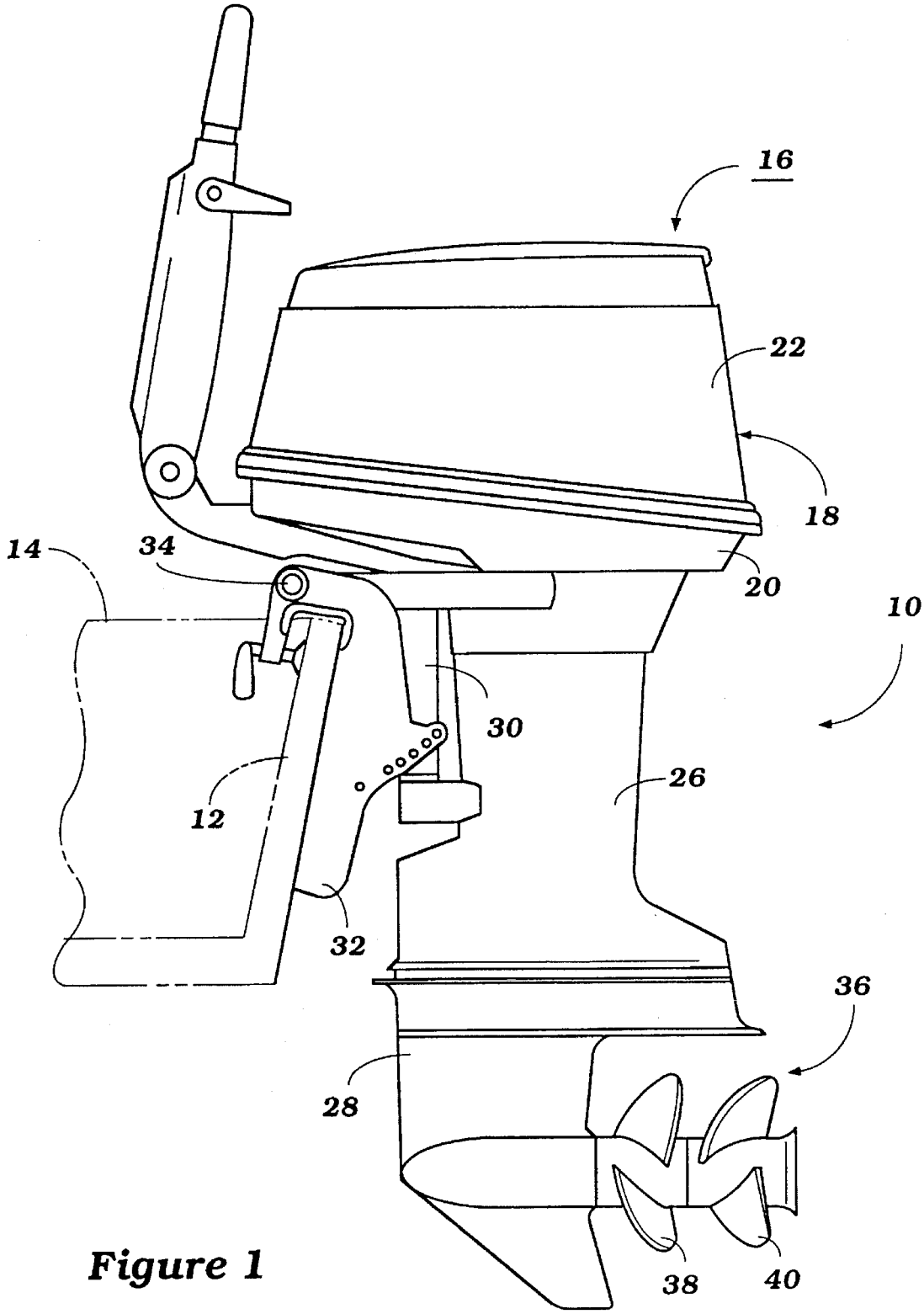
FIG. 1 is a side elevational view of an outboard drive which embodies a transmission in accordance with a preferred embodiment of the present invention.

FIG. 1 illustrates a marine outboard drive 10 configured in accordance with a preferred embodiment of the present invention. In the illustrated embodiment, the outboard drive 10 is depicted as an outboard motor for mounting on a transom 12 of a watercraft 14. It is contemplated, however, that those skilled in the art will readily appreciate that the present invention can be applied to stern drive units of inboard-outboard motors and to other types of watercraft drive units as well.

In the illustrated embodiment, the outboard drive 10 has a power head 16 which includes an engine. A conventional protective cowling 18 surrounds the engine. The cowling 18 desirably includes a lower tray 20 and a top cowling member 22. These components 20, 22 of the protective cowling 18 together define an engine compartment which houses the engine.

The engine is mounted conventionally with its output shaft (i.e., crankshaft) rotating about a generally vertical axis. The crankshaft (not shown) drives a drive shaft 24 (FIG. 2), as known in the art. The drive shaft 24 depends from the power head 16 of the outboard drive 10.

A drive shaft housing 26 extends downward from the lower tray 20 and terminates in a lower unit 28. The drive shaft 24 extends through and is journaled within the drive shaft housing 26, as known in the art.

A steering bracket 30 is attached to the drive shaft housing 26 in a known matter. The steering bracket 30 also is pivotably connected to a clamping bracket 32 by a pin 34. The clamping bracket 32, in turn, is configured to attach to the transom 12 of the watercraft 14. This conventional coupling permits the outboard drive 10 to be pivoted relative to the steering bracket 30 for steering purposes, as well as to be pivoted relative to the pin 34 to permit adjustment to the trim position of the outboard drive 10 and for tilt up of the outboard drive 10. Although not illustrated, it is understood that a conventional hydraulic tilt and trim cylinder assembly, as well as a conventional hydraulic steering cylinder assembly could be used as well with the present outboard drive 10.

The engine of outboard motor drives a propulsion device 36, such as, for example, a propeller, a hydrodynamic jet, or the like. In the illustrated embodiment of FIG. 1, the propulsion device 36 is a counter-rotating propeller device that includes a front propeller 38 designed to spin in one direction and to assert a forward thrust, and a rear propeller 40 designed to spin in the opposite direction and to assert a forward thrust.

Figure 2:
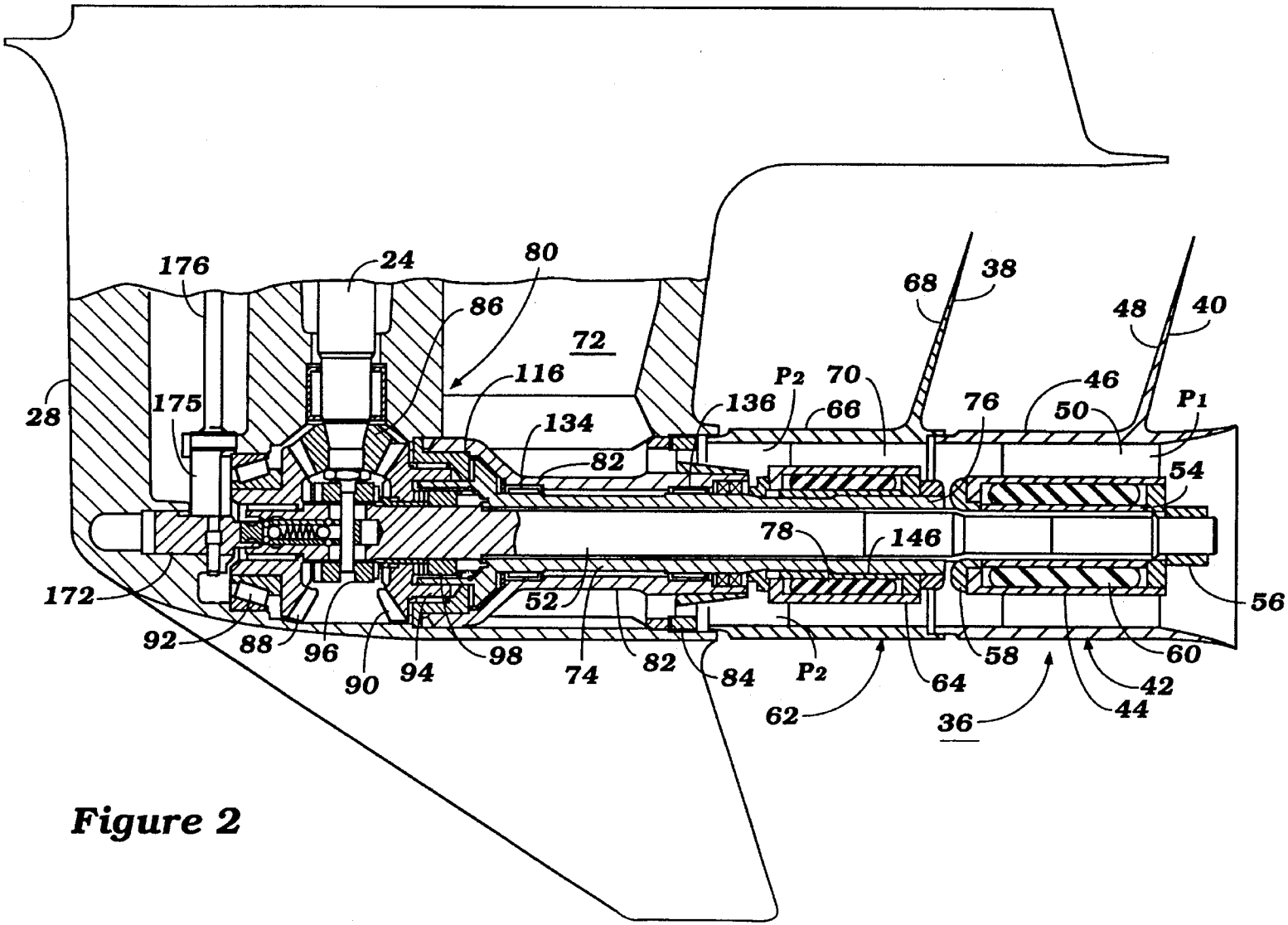
FIG. 2 is a sectional side elevational view of a lower unit of the outboard drive of FIG. 1 illustrating the transmission.

FIG. 2 illustrates the components of the front and rear propellers 38, 40. The rear propeller 40 includes a boss 42 which is formed in part by an inner sleeve 44 and an outer sleeve 46 to which the propeller blades 48 are integrally formed. A plurality of radial ribs 50 extend between the inner sleeve 44 and the outer sleeve 46 to support the outer sleeve 46 about the inner sleeve 44 and to form a passage $P_1$ through the propeller boss 42. Engine exhaust is discharged through the passage $P_1$, as known in the art.

An inner propulsion shaft 52 drives the rear propeller boss 42. For this purpose, the rear end of the inner shaft 52 carries an engagement sleeve 54 having a spline connection with the rear end of the inner shaft 52. The sleeve 54 is fixed to the rear end of the inner shaft 52 between a nut 56 threaded on the rear end of the shaft 52 and an annular retainer ring 58 positioned between the front and rear propellers 38, 40. An elastic bushing 60 is interposed between the engagement sleeve 54 and the rear propeller boss 42 and is compressed therebetween. The bushing 60 is secured to the engagement sleeve 54 by a heat process known in the art. The frictional engagement between the boss 42, the elastic bushing 60, and the engagement sleeve 54 is sufficient to transmit rotational forces from the sleeve 54, driven by the inner propulsion shaft 52, to the rear propeller blades 48.

The front propeller 38 likewise includes a front propeller boss 62. The front propeller boss 62 has an inner sleeve 64 and an outer sleeve 66. Propeller blades 68 of the front propeller 38 are integrally formed on the exterior of the outer sleeve 64. Ribs 70 interconnect the inner sleeve 66 and the outer sleeve 64 and form an axially extending passage $P_2$ between the sleeves 64, 66. The passage $P_2$ communicates with a conventional exhaust discharge passage 72 in the lower unit and with the exhaust passage of the rear propeller boss $P_1$.

An outer shaft 74 carries the front propeller 38. As best seen in FIG. 2, the rear end portion of the outer shaft 74 carries a front engagement sleeve 76 in driving engagement thereabout by a spline connection. The front engagement sleeve 76 is secured onto the outer shaft between the annular retaining ring 58 and the lower unit 28.

A front annular elastic bushing 78 surrounds the front engagement sleeve 76. The bushing 78 is secured to the sleeve 76 by heat process known in the art.

The front propeller boss 62 surrounds the elastic bushing 78, which is held under pressure between the boss 62 and the sleeve 76 in frictional engagement. The frictional engagement between the propeller boss 62 and the bushing 78 is sufficient to transmit a rotational force from the sleeve 76 to the propeller blades 68 of the front propeller bobs 62.

As seen in FIG. 2, the inner and outer propulsion shafts 52, 74 and the drive shaft 24 desirably extend at generally right angles to each other. A transmission 80 selectively interconnects the drive shaft 24 to the propulsion shafts 52, 74. The propulsion shafts 52, 74 extend from the transmission 80, through a bearing carrier 82 of the lower unit 28. A front ring nut 84, which is attached to the lower unit 28, secures the bearing carrier 82 to the lower unit 28.

The transmission 80 advantageously is a forward-neutral-reverse-type transmission. The transmission simultaneously drives the inner and outer propulsion shafts 52, 74 in opposite directions under a forward drive condition. Because the pitch of the propeller blades 48, 68 are of opposite hand, the oppositely spinning blades 48, 68 both assert a forward driving thrust when driven under a forward drive condition. Under a reverse drive condition, the transmission 80 desirably drives only one of the propellers 38, 40. In the illustrated embodiment, the transmission 80 drives only the inner propeller shaft 52 and thus the rear propeller 40 under a reverse drive condition; however, the transmission 80 can be configured alternatively to drive the front propeller 38 or both propellers 38, 40 when driven under a reverse drive condition.

With reference to FIG. 2, the drive shaft 24 carries a drive gear or pinion 86 at its lower end, which is disposed within the lower unit 28 and which forms a portion of the transmission 80. The drive gear 86 preferably is a bevel type gear.

The transmission 80 also includes a pair of counter-rotating driven gears 88, 90 that are in mesh engagement with the drive gear 86. The pair of driven gears 88, 90 preferably are positioned on diametrically opposite sides of the drive gear 86 and are suitably journaled within the lower unit 28 by front and rear bearing assemblies 92, 94, respectively, as described below.

FIG. 2 also illustrates a front clutch 96 and a rear clutch 98 of the present transmission 80. As discussed in detail below, the front clutch 96 selectively couples the inner propulsion shaft 52 to either to the front gear or to the rear gear. The rear clutch 98 selectively couples the outer propulsion shaft 74 to the rear gear 90. In the illustrated embodiment, the clutches 96, 98 are positive clutches, such as, for example, dog clutches; however, it is understood that the present transmission could be designed with friction-type clutches. The individual components of the present transmission 80 will now be described in detail.

Figure 3:
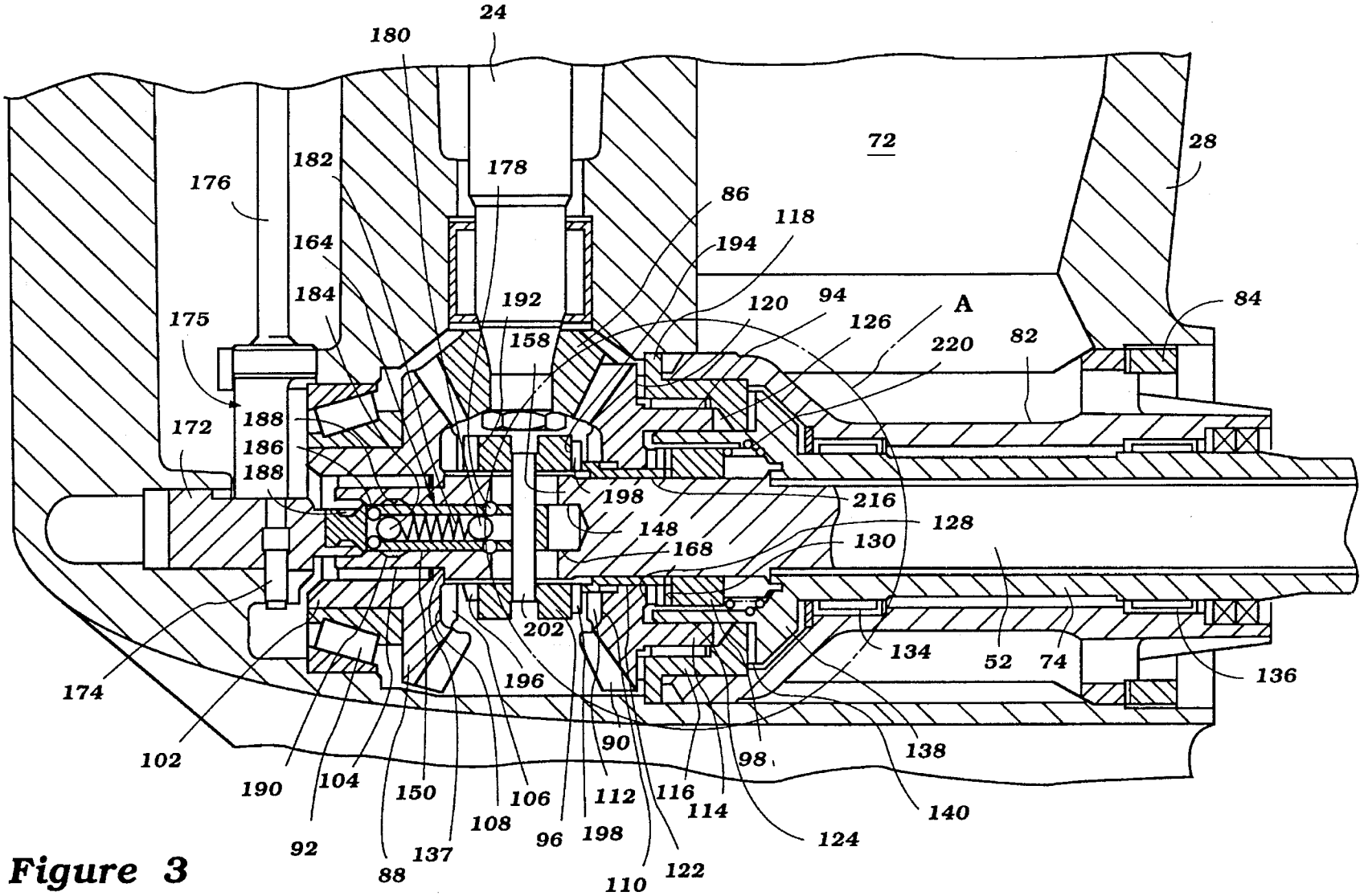
FIG. 3 is an enlarged, sectional side elevational view of the transmission of FIG. 2.

With reference to FIG. 3, each driven gear 88, 90 of the transmission 80 is positioned at about a 90° shaft angle with the drive gear 86. That is, the propulsion shafts 52, 74 and the drive shaft 24 desirably intersect at about a 90° shaft angle; however, it is contemplated that the drive shaft 24 and the propulsion shafts 52, 74 can intersect at almost any angle.

In the illustrated embodiment, the pair of driven gears are a front bevel gear 88 and an opposing rear bevel gear 90. The front gear 88 includes a bearing hub 102 which is journaled within the lower unit by the front thrust bearing 92. The front thrust 92 bearing rotatably supports the front gear 88 in mesh engagement with the drive gear 86.

The hub 102 has a central bore through which the inner propulsion shaft 52 passes when assembled. A plurality of needle bearings 104 journal the inner propulsion shaft 52 within the central bore of the front gear hub 102. As seen in FIG. 3, the inner propulsion shaft 52 includes a step diameter section to form a seat for the needle bearings 104 in this location.

The front gear 88 also includes a series of teeth 106 formed on an annular rear facing engagement surface 108. The teeth 106 positively engage the front clutch 96 of the transmission 80, as discussed below.

As seen in FIG. 3, the rear gear 90 also includes an annular front engagement surface 110 which carries a series of clutching teeth 112. The teeth 112 are configured to positively engage the front clutch 96 of the transmission 80, as discussed below.

The rear gear 90 includes a bearing hub 114 which is suitably journaled within the bearing carrier 82 of the lower unit 28 by the needle bearing assembly 94. The rear bearing assembly 94 rotatably supports the rear gear 90 in mesh engagement with the drive gear 86. The needle bearing assembly 94 includes an outer cage 116 that is received within an enlarged forward portion of the bearing carrier 82. A thrust bearing assembly 120 is interposed between the rear gear 90 and a lip 118 of the outer cage 116 to take the thrust loading on the rear gear 90.

Figure 4:
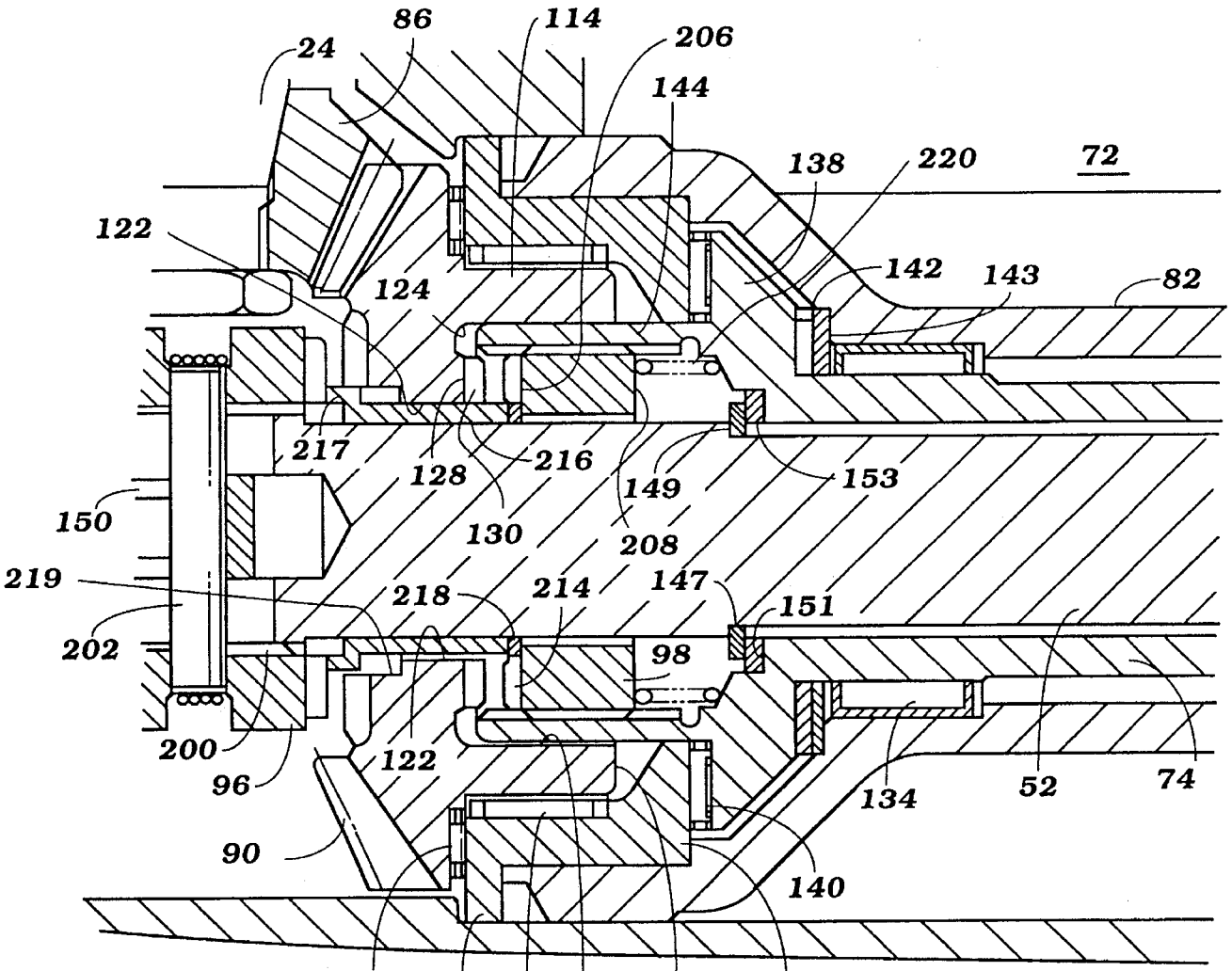
FIG. 4 is a an enlarged, sectional side elevational view of the area within the circle A of FIG. 3.

As best seen in FIG. 4, the bearing hub 114 of the rear gear 90 advantageously has a hollow shape with a stepped diameter formed by an inner bore 122 and a counterbore 124. The inner bore 122 extends entirely through the gear 90 from the front engagement surface 110 to a rear end 126 of the hub 114. The inner bore 122 has a sufficiently sized diameter to receive the inner propulsion shaft 52 as well as a portion of the clutch actuator mechanism when assembled, as described below.

The counterbore 124 extends into the hub 114 from its rear end 126 and terminates at a rear engagement surface 128 defined within the hollow bearing hub 114. The counterbore 124 has a sufficiently sized diameter to receive an end of the outer propulsion shaft 74 and a substantial portion of the rear clutch 98.

The rear engagement surface 128 of the rear gear hub 114 desirably lies generally parallel to the front engagement surface 110 and generally perpendicular to the axis of the inner bore 122. The rear engagement surface 128 carries a series of clutching teeth 130 which engage a portion of the rear clutch 98 as discussed below.

As best seen in FIG. 3, the inner propulsion shaft 52 and the hollow outer propulsion shaft 74 extend from the transmission 80 through the bearing carrier 82. The bearing carrier 82 rotatably supports the outer propulsion shaft 74, with the inner propulsion shaft 52 journaled within the outer propulsion shaft 74. A front needle bearing assembly 134 journals a front end of the outer propulsion shaft 74 within the bearing carrier 82, and a rear needle bearing assembly 136 supports the outer propulsion shaft 74 at the rear end of the bearing carrier 82.

The inner shaft 52 includes a front facing thrust shoulder 137 which acts against the front engagement surface 108 of the front gear 88. The inner shaft 52 transfers forward driving thrusts to the front gear 88 through this contact. The front trust bearing assembly 92 takes this trust loading in addition to the normal loading on the front driven bevel gear 88.

With reference to FIG. 4, the outer propulsion shaft 74 also includes an integrally formed thrust flange 138 located forward of the front needle bearing assembly 134. The thrust flange 138 has a forward facing thrust surface that engages a thrust bearing assembly 140 so as to transfer the forward driving thrust from the propeller 38 through the thrust bearing 140 and outer cage 116 to the lower unit 28. Rearward driving thrusts are transmitted to the bearing carrier 82 and lower unit housing 28 from a rear facing thrust shoulder of the thrust flange 138. The rearward facing thrust shoulder of the thrust flange 138 engages a needle-type thrust bearing 142 having an outer race 143 that contacts a front-facing shoulder of the bearing carrier 82.

As best seen in FIG. 4, the outer propulsion shaft 74 includes an integrally formed rim 144 that extends from the thrust flange 138 in the forward direction. The front rim 144 has an outer diameter which is slightly smaller than the diameter of the counterbore 124 of the rear gear hub 114 so as to fit within the counterbore 124 of the rear gear hub 114. The front rim 144 also has an inner diameter which is sized to receive the rear clutch 98, as discussed below.

With reference to FIG. 3, the inner propulsion shaft 52, as noted above, extends through front gear hub 102 where the needle bearing rows 104 journal the front end of the inner propulsion shaft 52 within the front gear 88. The inner propulsion shaft 52 also extends through the rear gear hub 114 and through the hollow outer propulsion shaft 74. As seen in FIG. 2, a needle bearing assembly 146 journals and supports the inner shaft 52 at the rear end of the outer propulsion shaft 74. The inner shaft 52 projects beyond the rear end of the outer shaft 74 to support the rear propeller 40.

As best seen in FIG. 4, the inner shaft 52 includes a step in diameter at an axial location generally corresponding with the position of the thrust flange 138 of the outer shaft 74. The step diameter at this location forms a seat 147 in which a member 149 is seated so as to rotate with the inner propulsion shaft 52. In the illustrated embodiment, the member 149 is formed as a washer. The seat include a rear facing annular transverse face which the washer 149 abuts.

The washer 149 has an inner diameter generally matching the small diameter of the shaft 52 at the seat 147, and an outer diameter which is larger than the large diameter of the shaft 52 at the seat 147. The washer 149 projects beyond the periphery surface of the inner shaft 52 into the space within the front rim 144 of the outer shaft 74 behind the rear clutch 98.

The outer shaft 74 includes a counterbore 151 positioned proximate to the seat 147 of the inner propulsion shaft 52. The counterbore defines a front facing annular surface of the outer shaft 74 positioned generally within the front rim 144. The counterbore desirably is positioned at the transition between the front rim 144 and an inner bore of the outer shaft 74, through which the inner shaft 52 passes when assembled.

The counterbore 151 is sized to receive a second member 153. In the illustrated embodiment, the second member is formed as a washer. The second washer 153 has an inner diameter which is at least as large as the inner bore of the outer shaft 74 so as not to interfere with the inner shaft 52. The second washer 153 desirably rotates with the outer shaft 74.

When assembled, the second washer 153 contacts the first washer 149 carried by the inner propulsion shaft 52 when seated in the counterbore 151. The washers 149, 153 overlap in the transverse direction (i.e., in the direction normal to the common longitudinal axis of the shafts 52, 74). As such, the outer diameter of the first washer 149 is larger than the inner diameter of the second washer 153.

The members 149, 153 desirably are anti-friction members which reduces friction between the rotating shafts 52, 74. Although in the illustrated embodiment the members 149, 153 are formed as washers, it is understood that other means for reducing friction, such as, for example, bearings and bushings, which also transfers axial loadings, can alternatively be used as the members 149, 153 positioned at this interface between the inner and outer shafts 52, 74.

Minimal friction is produced between the anti-friction members 149, 153 as the propulsion shafts 52, 74 rotate in opposite directions. Thrust loadings produced under a rear drive condition, however, are transferred from the inner propulsion shaft 52 to the outer propulsion shaft 74 through the anti-friction members 149, 153. The reverse thrust loadings are then transferred to the bearing carrier 82, as described above.

The anti-friction washers 149,153 desirably are formed of a self-lubricating material, such as, for example Teflon®. The washers 149, 153, however, can be made of other suitable materials (e.g., brass) which will be readily apparent to those skilled in the art.

With reference back to FIG. 3, the front end of the inner propulsion shaft 52 includes a longitudinal bore 148 which stems from the front end of the inner shaft 52 to a position on the rear side of the axis of the drive shaft 24. A front aperture 158 also extends through the inner shaft 52, transverse to the axis of the longitudinal bore 148, at a generally symmetric position between the driven gears 88, 90.

A plunger 150 which has a generally cylindrical rod shape and slides within the longitudinal bore 148 of the inner shaft 52 to actuate the clutches 96, 98. In the illustrated embodiment, the plunger 150 is hollow and houses a neutral detent mechanism 164. The detent mechanism 164 will be discussed below.

The plunger 150 also defines a hole 168 that is positioned generally transverse to the longitudinal axis of the plunger 150. The hole 168 is generally located symmetrically in relation to the aperture 158 of the inner propulsion shaft 52.

As understood from FIG. 3, the forward end of the plunger 150 is captured within a slot formed in an actuating cam follower 172 which is slidably supported in a known manner in the front of the lower unit 28. The interconnection between the actuating cam follower 172 and the front end of the plunger 150 allows the plunger 150 to rotate with the inner shaft 52 relative to the actuating cam follower 172.

The actuating cam follower 172 receives a crank portion 174 of an actuating cam 175 attached to the lower end of an actuating rod 176. The actuating rod 176 is journaled for rotation in the lower unit 28 and extends upwardly to a transmission actuator mechanism (not shown). Rotation of the actuating rod 176 rotates the cam 175 which positively reciprocates the cam follower 172 and the plunger 150 so as to shift the clutches 96, 98 between a forward drive position in which the front and rear clutches 96, 98 engage the front and rear gears 88, 90, respectively, a position of non-engagement (i.e., the neutral position shown in FIG. 3), and a reverse drive position in which the front clutch 96 engages the rear gear 90.

The transmission 80 also desirably includes the detent mechanism 164 which cooperates between the plunger 150 and the inner propulsion shaft 52 to retain the clutches 96, 98 in the neutral position and to provide a predetermined force to resist shifting for torsionally loading the shift rod 176. The torsional loading of the shift rod 176 promotes snap engagement between the clutches 96, 98 and gears 88, 90 in the forward and reverse drive positions. This mechanism is of the type described in U.S. Pat. No. 4,570,776, issued Feb. 18, 1986, and entitled "Detent Mechanism for Clutches," which is assigned to the Assignee hereof. This patent provides full details of the detent mechanism, and also the clutch actuating mechanism as thus far described, and is hereby incorporated by reference.

The detent mechanism 164 includes a plurality of detent balls 178 retained within the hollow bore of the plunger 150. A larger ball 180, urged by a compression spring 182, engages the detent balls 178. The opposite end of the spring 182 engages another large ball 184 which operates with the detent balls 186 to urge then into engagement with cam grooves 188 formed in the inner surface of the longitudinal groove 148 in the front end of the inner propulsion shaft 52. The detent balls 186, as illustrated in FIG. 3, also are urged into a further neutral locking groove 190. In view of the description of the detent mechanism incorporated by reference, a further description of the detent mechanism 164 is believed unnecessary.

As seen in FIG. 3, the front clutch 96 generally has a spool-like shape and includes an axial bore which extends between an annular front end plate 192 and an annular rear end plate 194. The bore is sized to receive the inner propulsion shaft 52.

The annular end plates 192, 194 of the front clutch 96 are substantially coextensive in size with the annular engagement surfaces 108, 110 of the front and rear gears 88, 90, respectively. The annular end plates 192, 194 each support a plurality of clutching teeth 196, 198 which correspond in size and number with the teeth 106, 112 formed on the respective engagement surfaces 108, 110 of the front and rear gears 88, 90.

The front clutch 96 has a spline connection (generally identified by reference numeral 200) to the inner propulsion shaft 52. Internal splines of the front clutch 96 mate with and engage external splines on the external surface of the inner drive shaft 52. This spline connection 200 provides a driving connection between the front clutch 96 and the inner propulsion shaft 52, while permitting the front clutch 96 to slide over the inner propulsion shaft 52, as discussed below.

As seen in FIG. 3, the front clutch 96 also includes a hole that extends through the midsection of the clutch 96 in a direction generally transverse to the longitudinal axis of the clutch 96. The hole is sized to receive a pin 202 which, when passed through the front aperture 158 of the inner propulsion shaft 52 and through front hole 168 of the plunger 150, interconnects the plunger 150 and the front clutch 96 with a portion of the inner shaft 52 interposed therebetween. The pin 202 may be held in place by a press-fit connection between the pin 202 and the front hole 168 of the plunger 150, or by a conventional coil spring (not shown) which is contained within a groove about the middle of the front clutch 96.

As best seen in FIG. 4, the rear clutch 98 has a cylindrical sleeve shape sized to fit within the front rim 144 of the outer propulsion shaft 74. External splines extend from the cylindrical external surface of the rear clutch 98. The external splines mate with corresponding internal splines on inner surface of the front rim 144 of the outer propulsion shaft 74 to establish a driving connection between the rear clutch 98 and the outer shaft 74, yet to permit the clutch 98 to slide along the axis of the shaft 72 within the bearing hub 114 of the rear gear 90.

The rear clutch 98 also includes an axial bore which extends between an annular front end plate 206 and a rear end 208. The bore is sized to receive the inner propulsion shaft 52.

The front annular end plate 206 of the rear clutch 98 is substantially coextensive in size with the rear annular engagement surface 128 of the rear gear 90. Teeth 214 extend from the front end plate 206 of the rear clutch 98 and desirably correspond to the teeth 130 of the rear gear 90 in size (e.g., axial length), in number, and in configuration.

As understood from FIG. 3, the operation of the rear clutch 98 occurs within the bearing hub 114 of the rear gear 90. That is, the movement of the clutch 98 from a position of non-engagement to a position of engagement occurs within the bearing hub 114 of the rear gear 90, and the driving connection between the rear clutch 98 and outer propulsion shaft 74 also occurs within the bearing hub 114 of the rear gear 90.

With reference to FIG. 4, the clutch actuation mechanism also includes a sleeve bushing 216 which passes through an inner bore 122 of the rear gear 90 and surrounds a portion of the inner propulsion shaft 52 in this position. The bushing 216 is sized to smoothly slide over the inner propulsion shaft 52 and through the inner bore 122 of the rear gear 90, as discussed below. In the illustrated embodiment, the bearing sleeve 216 desirably is fixed to the inner shaft 52 in a manner which allows the sleeve 216 to slide over the shaft 52 in the forward and rearward directions, but which causes the sleeve 216 to rotate with the inner shaft 52. The bushing 216 thus journals the shaft 52 within the inner bore 122 of the rear gear 90.

The sleeve 216 desirably is fixed to the front clutch 96. In the illustrated embodiment, the sleeve 216 includes an enlarged front end 217 which receives a portion of the front clutch 96. This engagement between the front clutch 96 and the sleeve 216 is maintained through conventional means such as a press-fit interference, a threaded connection, or the like. As such, the sleeve 216 slides axially along the inner shaft 52 with the front clutch 96.

As seen in FIG. 4, the rear gear 90 includes a front counterbore 219. The counterbore 219 is sized to receive the enlarged front end 217 of the sleeve 216 when the front clutch 96 engages the rear gear 90. In this manner, operation of the sleeve 216 does not interfere with the coupling operation between the front clutch 96 and rear gear 90.

The bushing sleeve 216 extends between a rear engagement surface 194 of the front clutch 96 and a front engagement surface 206 of the rear clutch 98, and contacts the front engagement surface 206 at a location which does not interfere with the clutching operation of the rear clutches 98. In the illustrated embodiment, the rear end of the bushing sleeve 216 directly contacts an anti-friction washer 218 which rests against the front engagement surface 206 of the rear clutch 98 to minimize friction between these components, which under the forward and reverse drive conditions rotate relative to each other.

At least one biasing member 220 (e.g., a compression spring) of the clutch actuation mechanism contacts the rear end 208 of the rear clutch 98. The biasing member 220 biases the clutch 98 towards the rear engagement surface 128 of the rear gear 90. The biasing member 220 extends between the rear end 208 of the rear clutch 98 and a front surface of the outer propulsion shaft thrust flange 138.

The operation of the present transmission 80 will now be described with primary reference to FIG. 3. FIG. 3 illustrates the front and rear clutches 96, 98 in a neutral position, i.e., in a position of non-engagement with the gears 88, 90. The detent mechanism 164 retains the plunger 150 and coupled the clutches 96, 98 in this neutral position.

To establish a forward drive condition, the actuator cam 172 moves the plunger 150 forward, which in turn, slides the front and rear clutches 96, 98 forward over the inner propulsion shaft 52. The forward motion of the plunger 150 positively forces the front clutch 96 into engagement with the front gear 88 with the corresponding clutching teeth 106, 196 mating. The forward motion of the plunger 150 also positively forces the rear clutch 98 to engage the rear gear 90 with the corresponding clutching teeth 130, 214 mating.

So engaged, the front gear 88 drives the inner propulsion shaft 52 through the internal spline connection 200 between the clutch and inner propulsion shaft 52. The inner propulsion shaft 52 thus drives the rear propeller 40 (FIG. 2) in a first direction which assert a forward thrust. As understood from FIG. 3, the rear gear 90 similarly drives the outer propulsion shaft 74 through the external spline connection between the rear clutch 98 and outer propulsion shaft 74. The outer propulsion shaft thus drives the front propeller 38 (FIG. 2) to spin in an opposite direction to that of the rear propeller 40 and to assert a forward thrust.

With reference back to FIG. 3, to establish a reverse drive condition, the actuator cam 172 moves the plunger 150 in the rearward direction, which in turn, slides the front and rear clutches 96, 98 rearward over the inner propulsion shaft 52. The rearward motion of the plunger 150 positively forces the front clutch 96 to engage the rear gear 90 with the corresponding clutching teeth 112, 198 mating. So engaged, the rear gear 90 drives the inner propulsion shaft 52 through the internal spline connection 200 between the clutch 96 and inner propulsion shaft 52. The inner propulsion shaft 52 thus drives the rear propeller 40 (FIG. 2) in a direction which assert a reverse thrust to propel the watercraft 14 (FIG. 1) in a reverse direction.

As seen in FIG. 3, the rear clutch 98 slides within the overlapping front rim 144 and the bearing hub 114. The front rim 144 has a sufficient axial length to permit the rear clutch 98 to move from its neutral position in the rearward direction by a sufficient travel to allow the front clutch 96 to engage the rear gear 90 without interference.

Figure 5:
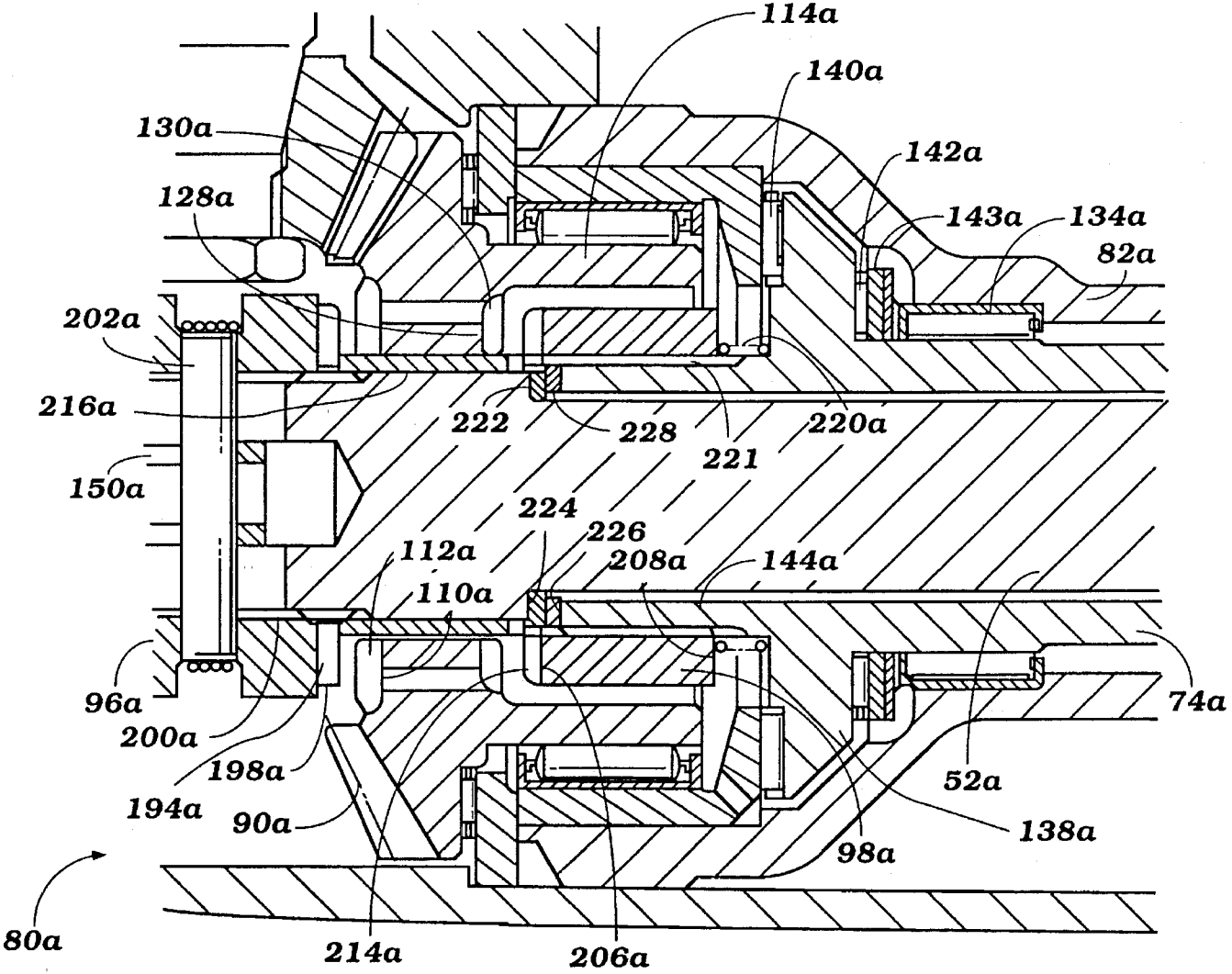
FIG. 5 is an enlarged, sectional side elevational view of a portion of a transmission configured in accordance with another preferred embodiment of the present invention.

FIG. 5 illustrates another preferred embodiment of the present transmission. Where appropriate, like numbers with an "a" suffix have been used to indicate like parts between the two embodiments for ease of understanding. The foregoing discussion should be understood as applying equally to the present transmission 80*a*, unless specified to the contrary.

As seen in FIG. 5, the rear clutch 98*a* is positioned about a portion of the outer propulsion shaft 74*a* within the hollow hub 114*a* of the rear driven gear 90*a*. The rear clutch 98*a* has a generally tubular body extending from a front engagement plate 206*a* to a rear end 208*a*. The front engagement plate 206*a* carries a series of clutching teeth 214*a* which selectively engage corresponding clutching teeth 130*a* carried by a rear engagement surface 128*a* of the rear gear 90*a*.

The clutch 98*a* also includes an inner bore which extends between the front engagement surface 206*a* and the rear end 208*a*. The inner bore has a sufficient size to receive a portion of the inner propulsion shaft 52*a* and a portion of the outer propulsion shaft 74*a*, as seen in FIG. 5.

In this embodiment, the outer propulsion shaft 74*a* includes a front rim 144*a* which extends forward of a thrust flange 138*a* of the shaft 74*a*. The front rim 144*a* has a outer diameter generally equal to the diameter of the outer propulsion shaft 74*a* behind the thrust flange 138*a* and is sized to fit within the inner bore of the rear clutch 98*a*. The front rim 144*a* also has an inner diameter which is sized to receive a portion of the inner propulsion shaft 52*a*.

A spline connection 221 couples the rear clutch 98*a* to the front rim 144 of the outer propulsion shaft 74*a*. Internal splines formed inside the inner bore of the rear clutch 98*a* mate with external splines formed on the exterior of the front rim 144*a* of the outer propulsion shaft 74*a*. The spline connection 221 allows the clutch 98*a* to rotatably drive the outer propulsion shaft 74*a*, yet allows the clutch 98*a* to slide over the shaft 74*a* relative to the rear gear 90*a* for selective engagement with the gear 90*a*, as discussed below.

A bearing sleeve 216*a* extends through the bore of the rear gear 90*a* and acts as a spacer between the front and rear clutches 96*a*, 98*a*. The bearing sleeve 216*a* is sized to journal the inner shaft 52*a* through the bore of the rear gear 90*a* and to smoothly slide over the inner shaft 52*a*. In the illustrated embodiment, the bearing sleeve 216*a* is captured between the rear engagement surface 194*a* of the front clutch 96*a* and the front engagement surface 206*a* of the rear clutch 98*a*. The bearing sleeve 216*a* contacts the engagement surface 194*a*, 206*a* of each clutch 96*a*, 98*a* at a location which does not interfere with the clutching operation of the clutch 96*a*, 98*a*.

As also seen in FIG. 5, the inner propulsion shaft 52*a* includes a step 222 formed by a step in shaft diameter. The step 222 is located within the hollow bearing hub 114*a* of the rear gear 90*a*, just forward of an end 226 of the outer propulsion shaft front rim 144*a*. The inner propulsion shaft 52*a* transitions in diameter at the step 222 from a larger diameter, which generally matches the outer diameter of the front rim 144*a* of the outer propulsion shaft 74*a*, to a smaller diameter, which is slightly less than the inner diameter of the hollow outer propulsion shaft 74*a*. The step 22 forms a rear facing, annular transverse surface and the front end 226 of the outer shaft 74*a* presents an opposing, front facing, annular transverse surface.

A gap exists between the step 222 of the inner propulsion shaft 52*a* and the front end 226 of the outer propulsion shaft 74*a*. A pair of anti-friction washer 224, 28 fill the gap. A first washer 224 has an inner diameter sized to fit tightly over the smaller diameter section of the inner shaft 52*a* and an outer diameter which is larger than the inner diameter of the outer propulsion shaft front rim 144*a*. The washer 224, however, is configured not to interfere with the actuation of the rear clutch 98*a*. The first washer 224 rotates with the inner shaft 52*a*.

The second washer 228 has an inner diameter larger than the small diameter of the inner shaft 52*a* at the step 222. The inner diameter desirably matches that of an inner diameter of the outer shaft 74*a*. The outer diameter of the second washer 228 is larger than the large diameter of the inner shaft 52*a* at the step 222. The outer diameter of the second washer 228 desirably matches the outer diameter of the outer shaft 74*a* at its front end 226.

The second washer 228 covers and acts against the front end 226 of the outer shaft rim 144*a*. When assembled, the second washer desirably rotates with the outer shaft 74*a*.

As seen in FIG. 5, the washers 224, 228 overlap in the transverse direction when positioned against the respective shafts 52*a*, 74*a*. Minimum friction is produced between the anti-friction washers 224, 228 as the propulsion shafts 52, 74 rotate in opposite directions. Thrust loadings produced under a rear drive condition, however, are transmitted from the inner shaft 52*a* to the outer shaft 74*a* through the washers 224, 228, and then to the bearing carrier 82*a*, as described above.

As with the above-described embodiment, the anti-friction washers 224, 228 desirably are formed of a self-lubricating material, such as, for example Teflon®. The washers 224, 228, however, can be made of other suitable materials (e.g., brass) which will be readily apparent to those skilled in the art.

The following elaborates on the previous description of the operation of the present transmission 80*a*. FIG. 5 illustrates the front and rear clutches 96*a*, 98*a* in a neutral position. The bearing sleeve 216*a* acts as a spacer between the front and rear clutches 96*a*, 98*a* and prevents the rear clutch 96*a* from moving in the forward direction, despite the bias in this direction produced by the biasing member 220*a*. The biasing member 220*a* urges the rear clutch 98*a* into contact with the bearing sleeve 216, and inhibits movement of the rear clutch 98*a* in the rearward direction (i.e., in a direction towards the propellers 38, 40). In this manner, the combination of the bearing sleeve 216 and the biasing member 228 couple the rear clutch 98*a* with the front clutch 96*a* such that these clutching elements 96*a*, 98*a* move together, as well as maintain the position of the rear clutch 98*a* relative to the front clutch 98*a*.

To establish the forward drive condition, an actuator cam (not shown) moves the plunger 150*a* forward, which in turn, slides the front clutch 96*a* forward over the inner propulsion shaft 52*a*. The forward motion of the plunger 150*a* positively forces the front clutch 96*a* to engage the front gear (not shown) with the corresponding clutching teeth mating. So engaged, the front gear 88*a* drives the inner propulsion shaft 52*a* through the spline connection 200*a* between the clutch and inner propulsion shaft 52*a*. The inner propulsion shaft 52*a* thus drives the rear propeller 40*a* (FIG. 1) in a first direction which assert a forward thrust.

As seen in FIG. 5, the biasing member 220*a* urges the rear clutch 98*a* to follow the forward motion of the front clutch 96*a*. The bearing sleeve 216*a* slides over the inner shaft 52*a* between the clutches 96*a*, 98*a* as the clutches 96*a*, 98*a* simultaneously move in the forward direction. The biasing member 220*a* forces the rear clutch 98*a* into engagement with the rear clutching surface 128*a* of the rear gear 90*a* within the hollow bearing hub 114*a* of the rear gear 90*a*. The corresponding teeth 130*a*, 214*a* of the rear gear 90*a* and rear clutch 98*a* mate to establish a drive condition between these elements. So engaged, the rear gear 90*a* drives the outer propulsion shaft 74*a* through the spline connection 221 between the rear clutch 98*a* and outer propulsion shaft 74*a*. The outer propulsion shaft 74*a* thus drives the front propeller 38 (FIG. 1) to spin in an opposite direction to that of the rear propeller 40 and to assert a forward thrust.

To establish a reverse drive condition, the actuator cam moves the plunger 150*a* in the rearward direction, forcing the front teeth 196*a* of the front clutch 96*a* to disengage the corresponding teeth of the front gear. The rearward motion of the front clutch 96*a* also forces the bearing sleeve 216*a* to slide over the inner propulsion shaft 52*a*, which, in turn, forces the rear clutch 98*a* to disengage the rear gear 90*a* and compresses the biasing member 220*a*.

Continual rearward movement of the plunger 150*a* moves both clutches 96*a*, 98*a* through the neutral position to a position where the front clutch 96*a* engages the rear gear 90*a*. The clutching teeth 198*a* on the rear engagement surface 194*a* of the front clutch 96*a* mate with the clutching teeth 112*a* on the front engagement end 110*a* of the rear gear 90*a*. The rear gear 90*a* drives the clutch 96*a* and the connected inner propulsion shaft 52*a* through this positive coupling. The inner propulsion shaft 52*a* in turn drives the rear propeller 40 (FIG. 1) to spin in a direction which asserts a thrust to drive the watercraft 14 in a reverse direction.

As common to both embodiments described above, the trust loading under at least one driving condition is transferred from the inner shaft to the outer shaft though a coupling formed by opposing transverse surfaces of the shafts. Washers are interposed between the transverse surfaces in order to minimize frictional contact between the surfaces, while transmitting the applied force. The thrust loading is then transferred to the lower unit in a known manner.

This shaft arrangement reduces the loading on the rear gear and the corresponding thrust bearing assembly. The thrust bearing assembly thus can be designed for the normal loading which it experiences from the rear gear under all operating conditions. As a result, the reliability of the bearing improves while reducing the component cost of the transmission.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A transmission for a watercraft outboard drive, said transmission comprising first and second counter-rotating gears, a first clutch connected to a first propulsion shaft and adapted to selectively engage either said first gear or second gear to establish either a first or a second drive condition, and a second clutch coupled to said first clutch and connected to a second propulsion shaft, said second clutch adapted to selectively engage said second gear under one of said drive conditions, said first shaft including a step which receives a first member and said second shaft includes an abutment surface which a second member acts against, said first and second members being arranged to act against each other in a manner allowing the transfer of thrust loading on said first shaft to said second shaft through said step and said abutment surface under one of said drive conditions.

2. A transmission as in claim 1, wherein said first and second members are anti-friction washers which minimize friction between said first and second shafts when rotating relative to each other.

3. A transmission as in claim 2, wherein said first and second washers have different sizes.

4. A transmission as in claim 3, wherein said first washer has an outer diameter of a size larger than an inner diameter of said second washer.

5. A transmission as in claim 4, wherein said outer diameter of said first washer is larger than a large diameter of said first shaft at said step.

6. A transmission as in claim 4, wherein said outer diameter of said first washer is no greater than a large diameter of said first shaft at said step.

7. A transmission as in claim 1, wherein said first and second members are adapted to reduce friction between said first and second shafts.

8. A transmission as in claim 7, wherein said second shaft includes an enlarged diameter front rim which receive at least a portion of said second clutch, said second shaft including a counterbore positioned between an inner bore through which said first shaft extends and an inner diameter of said front rim, said abutment surface being formed on at the bottom of a counterbore which is sized to receive said second member.

9. A transmission as in claim 8, wherein said second shaft includes a thrust flange which circumscribes said second shaft at an axial location along said shaft proximate to said counterbore.

10. A transmission as in claim 9, wherein said abutment surface on said second shaft is positioned between said front rim of said second shaft and a rear facing surface of said thrust flange.

11. A transmission as in claim 10, wherein said step of said first shaft is positioned at an axial location along said first shaft proximate to said abutment surface of said second shaft and within said rim of said second shaft.

12. A transmission as in claim 11, wherein said first and second members overlap in a transverse direction.

13. A transmission as in claim 12, wherein said first member extends beyond an outer periphery surface of said first shaft in the transverse direction.

14. A transmission as in claim 13, wherein said second member has an inner diameter which is at least as large as the inner bore of said second shaft.

15. A transmission as in claim 7, wherein said abutment surface of said second shaft is formed on an end of said second shaft.

16. A transmission as in claim 15, wherein said first and second members overlap in a transverse direction.

17. A transmission as in claim 16, wherein said second gear includes a hollow bearing hub which receives a portion of said second clutch, said step and said abutment surface of said first and second shafts lying within said hollow bearing hub of said second gear.

18. A transmission as in claim 1, wherein said second shaft includes a thrust flange including a rear facing surface and said abutment surface is located along the common axis of said first and second shaft at a position between said step of said first shaft and said rear facing surface of said thrust flange.

19. A propulsion shaft assembly coupled to a marine outboard drive transmission, said propulsion shaft assembly comprising first and second coaxial shafts, said first shaft having a generally annular transverse surface which opposes a generally annular transverse surface of said second shaft, and at least first and second washers which separate said transverse surfaces, said first washer being coupled to said first shaft and said second washer being coupled to said second shaft, said washers being arranged to act against each other in a manner allowing the transfer of thrust loading on said first shaft to said second shaft in at least one axial direction.

20. A propulsion shaft assembly as in claim 19, wherein said second shaft includes a thrust flange including a rear facing thrust shoulder which acts on a housing which supports said second shaft, said first and second washers being positioned between said transverse surface of said first shaft and said rear facing thrust shoulder of said second shaft.

21. A propulsion shaft assembly as in claim 19, wherein said first washer is coupled with said first shaft so as to rotate with said first shaft, and said second washer is coupled with said second shaft so as to rotate with said second shaft.

22. A propulsion shaft assembly as in claim 19, wherein the first washer extends beyond a periphery surface of said first shaft in a transverse direction.

23. A propulsion shaft assembly as in claim 19, wherein said first shaft has a maximum outer diameter not greater than a minimum inner diameter of said second shaft.

24. A propulsion shaft assembly as in claim 19, wherein said second shaft has a minimum inner diameter smaller than a maximum outer diameter of said first shaft.

25. A propulsion shaft assembly as in claim 19, wherein said transverse surface of said second shaft is formed at an end of said second shaft.

26. A propulsion shaft assembly as in claim 19, wherein said transverse surface of said second shaft is formed within a hollow inner bore of said second shaft.

27. A propulsion shaft assembly as in claim 26, wherein said transverse surface of said second shaft is formed as the bottom surface of a counterbore within said second shaft, said counterbore being sized to receive said second washer.

28. A propulsion shaft assembly as in claim 27, wherein said second shaft includes a front rim which extends in front of said transverse surfaces toward the transmission.

29. A propulsion shaft assembly as in claim 19, wherein said first and second washers are anti-friction washers which minimize friction between said first and second shafts when rotating relative to each other.

* * * * *